US009637812B2

(12) United States Patent
Kubota

(10) Patent No.: US 9,637,812 B2
(45) Date of Patent: May 2, 2017

(54) NON-ORIENTED ELECTRICAL STEEL SHEET

(71) Applicant: NIPPON STEEL & SUMITOMO METAL CORPORATION, Tokyo (JP)

(72) Inventor: Takeshi Kubota, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 491 days.

(21) Appl. No.: 14/051,688

(22) Filed: Oct. 11, 2013

(65) Prior Publication Data

US 2014/0041769 A1 Feb. 13, 2014

Related U.S. Application Data

(63) Continuation of application No. 13/393,881, filed as application No. PCT/JP2010/064373 on Aug. 25, 2010, now abandoned.

(30) Foreign Application Priority Data

Sep. 3, 2009 (JP) ..... 2009-203806

(51) Int. Cl.

| | |
|---|---|
| ***C22C 38/02*** | (2006.01) |
| ***C22C 38/06*** | (2006.01) |
| ***C22C 38/12*** | (2006.01) |
| ***H01F 1/16*** | (2006.01) |
| ***C21D 8/12*** | (2006.01) |
| ***C22C 38/00*** | (2006.01) |
| ***C22C 38/04*** | (2006.01) |
| ***C22C 38/08*** | (2006.01) |

(52) U.S. Cl.

CPC ..... *C22C 38/02* (2013.01); *C21D 8/1233* (2013.01); *C21D 8/1283* (2013.01); *C22C 38/001* (2013.01); *C22C 38/002* (2013.01); *C22C 38/004* (2013.01); *C22C 38/04* (2013.01); *C22C 38/06* (2013.01); *C22C 38/08* (2013.01); *C22C 38/12* (2013.01); *H01F 1/16* (2013.01)

(58) Field of Classification Search

CPC ..... C22C 38/02; C21D 8/1222; C21D 8/1283
USPC ..... 148/307
See application file for complete search history.

(56) References Cited

U.S. PATENT DOCUMENTS

| | | | |
|---|---|---|---|
| 5,945,212 | A | 8/1999 | Tanaka et al. |
| 6,942,740 | B2 | 9/2005 | Hayakawa et al. |
| 2009/0202383 | A1 | 8/2009 | Tanaka et al. |
| 2011/0042625 | A1 | 2/2011 | Tanaka et al. |

FOREIGN PATENT DOCUMENTS

| | | | | |
|---|---|---|---|---|
| CN | 101218362 | | | 7/2008 |
| JP | 60-238421 | | | 11/1985 |
| JP | 61-9520 | | | 1/1986 |
| JP | 62054023 | A | * | 3/1987 |
| JP | 62-256917 | | | 11/1987 |
| JP | 1-162748 | | | 6/1989 |
| JP | 2-8346 | | | 1/1990 |
| JP | 3-223445 | | | 10/1991 |
| JP | 7-41919 | A | | 2/1995 |
| JP | 2002-220644 | | | 8/2002 |
| JP | 2003-342698 | | | 12/2003 |
| JP | 2005-113252 | | | 4/2005 |
| JP | 2006-161137 | | | 6/2006 |
| JP | 2006161137 | A | * | 6/2006 |

OTHER PUBLICATIONS

International Search Report dated Nov. 16, 2010, issued in corresponding PCT Application No. PCT/JP2010/064373.
Office Action dated Apr. 5, 2016 issued in related Chinese Application No. 201510066552.7.
Examination Report issued Dec. 26, 2016, in Indian Patent Application No. 2052/DELNP/2012.

* cited by examiner

*Primary Examiner* — Weiping Zhu
(74) *Attorney, Agent, or Firm* — Birch, Stewart, Kolasch & Birch, LLP

(57) ABSTRACT

A non-oriented electrical steel sheet contains 2.8 mass % or more and 4.0 mass % or less of Si, 0.2 mass % or more and 3.0 mass % or less of Al, and 0.02 mass % or more and 0.2 mass % or less of P. The non-oriented electrical steel sheet contains further contains 0.5 mass % or more in total of at least one kinds selected from a group consisting of 4.0 mass % or less of Ni and 2.0 mass % or less of Mn. A C content is 0.05 mass % or less, a N content is 0.01 mass % or less, an average grain diameter is 15 μm or less, and a <111> axial density is 6 or larger.

12 Claims, 1 Drawing Sheet

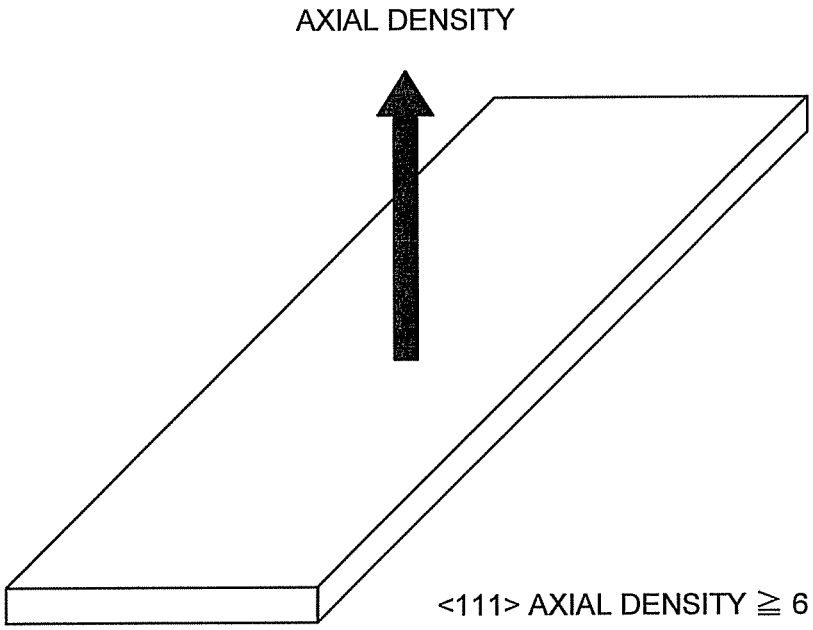
AXIAL DENSITY
<111> AXIAL DENSITY ≧ 6

NON-ORIENTED ELECTRICAL STEEL SHEET

This application is a continuation application of U.S. application Ser. No. 13/393,881, filed Mar. 2, 2012, which is a national stage application of International Application No. PCT/JP2010/064373, filed Aug. 25, 2010, which claims priority to Japanese Application No. 2009-203806, filed Sep. 3, 2009, each of which is incorporated by reference in its entirety.

TECHNICAL FIELD

The present invention relates to a non-oriented electrical steel sheet suitable for rotor of high-speed rotating machine.

BACKGROUND ART

Non-oriented electrical steel sheet is used for rotor of rotating machine, for example. In general, centrifugal force exerted on the rotor is in proportion to the radius of rotation, and in proportion to the square of the rotational speed. Accordingly, a very large stress is loaded on the rotor of the high-speed rotating machine. The non-oriented electrical steel sheet for rotor is, therefore, preferably given large tensile strength. In other words, the non-oriented electrical steel sheet for rotor is preferably a high tensile strength steel. As described in the above, the non-oriented electrical steel sheet for rotor is required to have high tensile strength.

On the other hand, it is important for the non-oriented electrical steel sheet, used for iron core not only for the rotor of rotating machine, to have a low iron loss. In particular for the non-oriented electrical steel sheet for the rotor of high-speed rotating machine, it is important for high-frequency iron loss to be low. As described herein, the non-oriented electrical steel sheet for rotor is also required to have a low level of high-frequency iron loss. In other words, the steel is required to ensure high efficiency, when the rotating machine is operated at high frequencies.

High tensile strength and low high-frequency iron loss are, however, contradictory issues, which may be satisfied at the same time only with great difficulty.

While there have been techniques ever proposed aiming at satisfying the both at the same time, no technique capable of readily manufacturing such steel has been known. For example, a technique of obtaining a high-Si-content hot rolled steel sheet, followed by temperature control in various ways, has been propped. However, the technique suffers from difficulty in cold rolling, due to the high Si content. Moreover, the technique needs various temperature controls for enabling the cold rolling, and the controls are highly specialized, so that time, labor and costs consumed therefor are pushed up.

CITATION LIST

Patent Literature

Patent Literature 1: Japanese Laid-Open Patent Publication No. S60-238421

Patent Literature 2: Japanese Laid-Open Patent Publication No. S61-9520

Patent Literature 3: Japanese Laid-Open Patent Publication No. S62-256917

Patent Literature 4: Japanese Laid-Open Patent Publication No. H02-8346

Patent Literature 5: Japanese Laid-Open Patent Publication No. 2003-342698

Patent Literature 6: Japanese Laid-Open Patent Publication No. 2002-220644

Patent Literature 7: Japanese Laid-Open Patent Publication No. H03-223445

SUMMARY OF INVENTION

Technical Problem

It is an object of the present invention to provide a non-oriented electrical steel sheet which may readily be manufactured, and may concurrently satisfy high tensile strength and low high-frequency iron loss.

Solution to Problem

The present inventors went through extensive investigations from the viewpoint of obtaining desirable mechanical characteristics of the non-oriented electrical steel sheet, while suppressing the iron loss at a low level, by way of solid solution strengthening, precipitation strengthening, work strengthening, grain refinement strengthening, and strengthening by phase-transformed structure.

As a consequence, the present inventors found out that the high-frequency iron loss may be suppressed to a low level, while achieving a high level of yield strength, by appropriately adjusting contents of Si, Mn, Ni and so forth, and by appropriately adjusting the average grain diameter and <111> axial density, details of which will be described later. The findings led us to a non-oriented electrical steel sheet described in the next.

A non-oriented electrical steel sheet according to the present invention contains: Si: 2.8 mass % or more and 4.0 mass % or less; Al: 0.2 mass % or more and 3.0 mass % or less; and P: 0.02 mass % or more and 0.2 mass % or less, and further contains 0.5 mass % or more in total of at least one kinds selected from a group consisting of 4.0 mass % or less of Ni and 2.0 mass % or less of Mn. A C content is 0.05 mass % or less, a N content is 0.01 mass % or less, a balance is composed of Fe and inevitable impurity, an average grain diameter is 15 μm, and a <111> axial density is 6 or larger.

Advantageous Effects of Invention

According to the present invention, since the average grain diameter and the <111> axial density are appropriately adjusted, so that high tensile strength and low high-frequency iron loss can be obtained. Also since contents of Si and so forth are appropriately adjusted, treatment in the process of manufacturing can be facilitated, making any complicated treatment possibly arising from embrittlement and so forth avoidable.

BRIEF DESCRIPTION OF DRAWINGS

FIG. 1 is a drawing illustrating axial density of a non-oriented electrical steel sheet.

DESCRIPTION OF EMBODIMENTS

The present invention will be detailed below. First, components of the non-oriented electrical steel sheet of the present invention will be explained.

C and N are used for forming carbonitride of Nb and so forth. The carbonitride enhances tensile strength of the non-oriented electrical steel sheet, through precipitation strengthening and grain refinement strengthening. A content of C less than 0.003 mass %, or a content of N less than 0.001 mass % tends to make the function insufficient. On the other hand, a content of C exceeding 0.05%, or a content of N exceeding 0.01 mass % results in considerable degradation in the iron loss characteristics due to magnetic ageing or the like. Accordingly, the content of C is adjusted to 0.05 mass % or less, and the content of N is adjusted to 0.01 mass % or less. The content of C is preferably 0.003 mass % or more, and the content of N is preferably 0.001 mass % or more.

Si reduces the iron loss such as high-frequency iron loss, by increasing electric resistance of the non-oriented electrical steel sheet to thereby reduce eddy current loss. Si also increases tensile strength of the non-oriented electrical steel sheet through solid solution strengthening. A content of Si less than 2.8 mass % makes these functions insufficient. On the other hand, a content of Si exceeding 4.0 mass % results in reduction in magnetic flux density, embrittlement, increase in difficulty of processing such as cold rolling, and increase in material cost. Accordingly, the content of Si is adjusted to 2.8 mass % or more and 4.0 mass % or less.

Al reduces the iron loss such as high-frequency iron loss, by increasing electric resistance of the non-oriented electrical steel sheet to thereby reduce eddy current loss, similarly to Si. A content of Al less than 0.2% makes these functions insufficient. On the other hand, a content of Al exceeding 3.0 mass % results in reduction in magnetic flux density, embrittlement, increase in difficulty of processing such as cold rolling, and increase in material cost. Accordingly, the content of Al is adjusted to 0.2 mass % or more 3.0 mass % or less. The content of Al is preferably 2.0 mass % or less, more preferably 1.5 mass % or less, and further more preferably 1.0 mass % or less.

Ni and Mn contribute to improvement in the tensile strength of the non-oriented electrical steel sheet. More specifically, Ni increases the tensile strength through solid solution strengthening, and Mn increases the tensile strength through solid solution strengthening and grain refinement strengthening. Ni also reduces the iron loss such as high-frequency iron loss, by increasing the electric resistance of the non-oriented electrical steel sheet to thereby reduce the eddy current loss. Ni still also contributes to improvement in the magnetic flux density of the non-oriented electrical steel sheet, accompanied by increase in saturation magnetic moment. Mn reduces the iron loss such as high-frequency iron loss, by increasing the electric resistance of the non-oriented electrical steel sheet to thereby reduce the eddy current loss. The total content of Ni and Mn content less than 0.5 mass % makes these functions insufficient, and results in an insufficient tensile strength. On the other hand, a content of Ni exceeding 4.0 mass % results in decrease in the magnetic flux density ascribable to reduction in the saturation magnetic moment. A content of Mn exceeding 2.0 mass % decreases the magnetic flux density, and increases the material cost. Accordingly, the steel contains 0.5 mass % or more in total of 4.0 mass % or less of Ni and/or 2.0 mass % or less of Mn.

P largely enhances the tensile strength of the non-oriented electrical steel sheet. P may, therefore, be contained for the purpose of further improving the tensile strength. A content of P less than 0.02 mass % makes the function insufficient. On the other hand, a content of P exceeding 0.2 mass % results in segregation of P at the grain boundary in the process of manufacturing, possibly making the hot-rolled steel sheet brittle, and making the succeeding cold rolling very difficult. Accordingly, the content of P is adjusted to 0.02 mass % or more and 0.2 mass % or less.

Nb reacts with C and N to generate Nb carbonitride, and enhances the tensile strength of the non-oriented electrical steel sheet through precipitation strengthening and grain refinement strengthening. Metal elements possibly forming carbonitrides in the non-oriented electrical steel sheet, other than Nb, are exemplified by Zr, V, Ti and Mo. Among them, Nb carbonitride shows a large contribution to precipitation strengthening. Nb also suppresses growth of crystal grains in the process of cold rolling and finish annealing, to thereby reduce the high-frequency iron loss. For this reason, Nb may be contained. Too large content of Nb, however, elevates recrystallization temperature or embrittles the non-oriented electrical steel sheet. Accordingly, assuming now [Nb] as the content of Nb in mass %, [C] as the content of C in mass %, and [N] as the content of N in mass %, a valued $R_{Nb}$ represented by [Nb]/8([C]+[N]) is preferably 1 or smaller. In view of obtaining the function described above, the value $R_{Nb}$ is preferably 0.1 or larger.

Components of the non-oriented electrical steel sheet other than those described in the above are Fe and inevitable impurity, for example. Also B may be contained for the purpose of avoiding embrittlement of the grain boundary accompanied by increased tensile strength. In this case, the content of B is preferably 0.001 mass % or more. On the other hand, a content of B exceeding 0.007 mass % reduces the magnetic flux density, and induces embrittlement in the process of hot rolling. Accordingly, the content of B is preferably 0.007 mass % or less.

Moreover, for the purpose of further improving various magnetic characteristics, 0.02% or more and 1.0% or less of Cu; 0.02% or more and 0.5% or less of Sn; 0.02% or more and 0.5% or less of Sb; 0.02% or more and 3.0% or less of Cr; and/or 0.001% or more and 0.01% or less of rare earth metal (REM) may be contained. In other words, a single or more elements selected from the group consisting of these elements may be contained.

According to the non-oriented electrical steel sheet composed of these components, a high yield strength and a low high-frequency iron loss can be obtained. In addition, when the average grain diameter and the <111> axial density of the non-oriented electrical steel sheet fall in appropriate ranges, higher tensile strength can be obtained, and the high-frequency iron loss can be further suppressed.

Now an appropriate ranges of the average grain diameter and the <111> axial density will be explained. The present inventors found out appropriate ranges from our experiments conducted as below. First, a slab which contains 0.029 mass % of C, 3.17 mass % of Si, 0.69 mass % of Al, 2.55 mass % of Ni, 0.03 mass % of P, 0.002 mass % of N, and 0.037 mass % of Nb was hot-rolled, to thereby obtain a hot-rolled steel sheet. The value $R_{Nb}$ of the hot-rolled steel sheet was 0.15. Next, the hot-rolled steel sheet was cold-rolled at each reduction listed in Table 1, to thereby obtain a series of cold-rolled steel sheets of 0.35 mm thick. Thereafter, the cold-rolled steel sheets were subjected to continuous finish annealing under conditions listed in Table 1, to obtain the non-oriented electrical steel sheets.

TABLE 1

| Sample | Rolling | Continuous finish annealing | |
|---|---|---|---|
| No. | reduction (%) | Temperature (° C.) | Time (sec) |
| 1 | 78 | 850 | 30 |
| 2 | 81 | 850 | 30 |
| 3 | 88 | 850 | 30 |

TABLE 1-continued

| Sample No. | Rolling reduction (%) | Continuous finish annealing Temperature (° C.) | Time (sec) |
|---|---|---|---|
| 4 | 90 | 850 | 30 |
| 5 | 90 | 725 | 30 |

The average grain diameter and the <111> axial density of the non-oriented electrical steel sheets were measured. Epstein specimens and tensile test pieces were cut from the non-oriented electrical steel sheets, and subjected to measurement of magnetic characteristics and mechanical characteristics. Results are shown in Table 2. In Tables below, "$W_{15/50}$" represents iron loss $W_{15/50}$, "B50" represents magnetic flux density B50, and "$W_{10/1000}$" represents iron loss $W_{10/1000}$. "YP" represents yield strength, "TS" represents tensile strength, and "EL" represents elongation.

TABLE 2

| Sample No. | Average grain diameter (μm) | <111> Axial density | Magnetic characteristics $W_{15/50}$ (W/kg) | B50 (T) | $W_{10/1000}$ (W/kg) | Mechanical characteristics YP (MPa) | TS (MPa) | EL (%) |
|---|---|---|---|---|---|---|---|---|
| 1 | 26 | 3.4 | 8.7 | 1.66 | 126 | 749 | 801 | 26 |
| 2 | 24 | 4.7 | 9.1 | 1.65 | 119 | 758 | 812 | 27 |
| 3 | 23 | 6.6 | 9.2 | 1.65 | 120 | 782 | 843 | 28 |
| 4 | 25 | 9.8 | 9.5 | 1.64 | 121 | 788 | 851 | 27 |
| 5 | 12 | 10.3 | 9.8 | 1.65 | 108 | 892 | 947 | 28 |

As is clear from Table 2, sample No. 5 showed high yield strength and tensile strength, and low high-frequency iron loss $W_{10/1000}$. On the other hand, each of samples No. 1 to No. 4 showed lower yield strength and tensile strength, and higher high-frequency iron loss $W_{10/1000}$, as compared with sample No. 5. Samples No. 1 and No. 2 showed extremely low yield strength and tensile strength. The average grain diameter is therefore adjusted to 15 μm or smaller, and the <111> axial density illustrated in FIG. 1 is adjusted to 6 or larger. In particular, the average grain diameter is preferably 13 μm or smaller, and more preferably 11 μm or smaller. In particular, the <111> axial density is preferably 9 or larger, and more preferably 10 or larger. While axial density in other crystal orientations including <001> is not specifically limited, the <001> axial density is preferably large.

The non-oriented electrical steel sheet according to the present invention may be manufactured as follows. First, a slab having the above described composition is produced from molten steel, and the slab is heated and hot-rolled to obtain a hot-rolled steel sheet. The hot-rolled steel sheet is then cold-rolled to obtain a cold-rolled steel sheet, followed by finish annealing. In view of avoiding degradation in strength and embrittlement accompanied by growth of the crystal grains, the hot-rolled steel sheet is preferably not annealed, and also preferably not subjected to intermediate annealing during cold rolling. By employing the hot-rolled steel sheet having the above-described composition, the tensile strength may be improved and the high-frequency iron loss may be reduced, without subjecting the hot-rolled steel sheet to annealing or intermediate annealing. Omission of the annealing of the hot-rolled steel sheet also improves the bendability. In short, the non-oriented electrical steel sheet of the present invention having the above-described composition may improve the tensile strength and may lower the high-frequency iron loss, only by relatively simple processes.

The average grain diameter is adjustable depending on conditions of finish annealing, for example. In order to adjust the average grain diameter to 15 μm or smaller, the finish annealing is preferably proceeded at 750° C. or below for 25 seconds or shorter, or at 740° C. or below for 30 seconds or shorter, and more preferably proceeded at 740° C. or below for 25 seconds or shorter. These ranges are apparent also from the above-described experiments. As described in the above, the hot-rolled steel sheet is preferably not annealed, and also preferably not subjected to intermediate annealing during cold rolling. This is because these sorts of annealing may make it difficult to adjust the average grain diameter to 15 μm or smaller.

The <111> axial density is adjustable depending on rolling reduction in cold rolling, for example. In order to adjust the <111> axial density to 6 or larger, the rolling reduction is preferably adjusted to 85% or larger, more preferably 88% or larger, and still more preferably 90% or larger. These ranges are apparent also from the above-described experiments. The <111> axial density is also adjustable by temperature of finish rolling in the hot rolling, and cooling conditions after hot rolling, for example. More specifically, for the case where the hot rolling involves rough rolling and succeeding finish rolling, the <111> axial density is adjustable by temperature of the hot-rolled steel sheet in finish rolling. In addition, for the case where the hot-rolled steel sheet is coiled after the hot rolling, the <111> axial density is adjustable by controlling temperature of the hot-rolled steel sheet in coiling (coiling temperature). The lower the temperature of the finish rolling is, the larger the ratio of area in the hot-rolled steel sheet is, the area causing therein no recrystallization. For this reason, the lower the finish rolling temperature is, the more readily the effects, similar to those obtained under large reduction in cold rolling, can be obtained. Accordingly, the finish rolling temperature is preferably set to a low level, and particularly preferably 850° C. or below. In addition, the lower the coiling temperature is, the larger the ratio of area in the hot-rolled steel sheet is, the area causing therein no recrystallization. Accordingly, also the coiling temperature is preferably set to a low level, and particularly preferably 650° C. or below.

EXAMPLE

First Experiment

First, slabs which contain the components listed in Table 3 and the balance of Fe and inevitable impurity were hot-rolled, to obtain hot-rolled steel sheets. Next, the hot-rolled steel sheets were cold-rolled at rolling reductions listed in Table 4, to thereby obtain cold-rolled steel sheets of 0.20 mm thick. The cold-rolled steel sheets were then subjected to continuous finish annealing under conditions listed in Table 4, to obtain the non-oriented electrical steel sheets.

TABLE 3

| Sample No. | | Component C | Si | Al | Ni | Mn | P |
|---|---|---|---|---|---|---|---|
| Comparative Example | 11 | 0.0022 | 3.20 | 0.65 | — | 0.19 | 0.04 |
| | 12 | 0.0018 | 3.21 | 0.67 | 2.56 | 0.20 | 0.05 |
| | 13 | 0.0021 | 3.25 | 0.70 | — | 1.61 | 0.04 |
| | 14 | 0.0023 | 3.23 | 0.63 | 2.58 | 1.57 | 0.04 |
| | 15 | 0.0019 | 3.31 | 0.66 | 2.59 | 1.60 | 0.05 |
| Example | 16 | 0.0020 | 3.27 | 0.68 | 2.55 | 1.58 | 0.04 |
| | 17 | 0.0025 | 3.35 | 0.70 | 2.49 | 1.62 | 0.04 |

TABLE 4

| Sample No. | | Rolling reduction (%) | Continuous finish annealing Temperature (° C.) | Time (sec) |
|---|---|---|---|---|
| Comparative Example | 11 | 83 | 820 | 40 |
| | 12 | 83 | 820 | 40 |
| | 13 | 83 | 820 | 40 |
| | 14 | 83 | 820 | 40 |
| | 15 | 89 | 820 | 40 |
| Example | 16 | 89 | 750 | 20 |
| | 17 | 89 | 720 | 20 |

The average grain diameter and the <111> axial density of the non-oriented electrical steel sheets were measured. Epstein specimens and tensile test pieces were then cut from the non-oriented electrical steel sheets. Magnetic characteristics were measured using the Epstein specimens, and mechanical characteristics were measured using the tensile test pieces. Results are shown in Table 5.

TABLE 5

| Sample No. | | Average grain diameter (μm) | <111> Axial density | Magnetic characteristics $W_{15/50}$ (W/kg) | B50 (T) | $W_{10/1000}$ (W/kg) | Mechanical characteristics YP (MPa) | TS (MPa) | EL (%) |
|---|---|---|---|---|---|---|---|---|---|
| Comparative Example | 11 | 24 | 4.1 | 4.7 | 1.67 | 51 | 531 | 628 | 31 |
| | 12 | 23 | 3.9 | 4.6 | 1.68 | 48 | 636 | 733 | 29 |
| | 13 | 23 | 4.4 | 4.9 | 1.67 | 49 | 573 | 672 | 28 |
| | 14 | 21 | 4.6 | 4.8 | 1.67 | 47 | 681 | 779 | 29 |
| | 15 | 22 | 8.6 | 5.0 | 1.66 | 48 | 710 | 821 | 29 |
| Example | 16 | 13 | 8.9 | 5.2 | 1.66 | 43 | 796 | 898 | 30 |
| | 17 | 10 | 8.2 | 5.0 | 1.66 | 40 | 819 | 917 | 31 |

As is known from Table 5, each of Comparative Examples No. 12 to No. 14 was found to show higher levels of yield strength and tensile strength, as compared with Comparative Example No. 11, by virtue of solid solution strengthening contributed by Ni and/or Mn. Comparative Example No. 15 was found to show higher levels of yield strength and tensile strength as compared with Comparative Examples No. 12 to No. 14, since the <111> axial density was 6 or larger.

Each of Examples No. 16 and No. 17 showed distinctively higher levels of yield strength and tensile strength, and a distinctively lower level of high-frequency iron loss $W_{10/1000}$ as compared with Comparative Example No. 15, since the <111> axial density was 6 or larger, and the average grain diameter was 15 μm or smaller. In this way, desirable magnetic characteristics and mechanical characteristics were obtained in Examples No. 16 and No. 17.

It is also clear from Table 4 and Table 5, that larger rolling reduction results in larger <111> axial density, and that lower temperature and shorter time of continuous finish annealing result in smaller average grain diameter.

Second Experiment

First, slabs which contain the components listed in Table 6 and the balance of Fe and inevitable impurity were hot-rolled, to obtain hot-rolled steel sheets. Next, the hot-rolled steel sheets were cold-rolled at rolling reductions listed in Table 7, to thereby obtain a series of cold-rolled steel sheets of 0.25 mm thick. The cold-rolled steel sheets were then subjected to continuous finish annealing under conditions listed in Table 7, to obtain the non-oriented electrical steel sheets.

TABLE 6

| Sample No. | | Component C | Si | Al | Ni | P | B | N | Nb | $R_{Nb}$ |
|---|---|---|---|---|---|---|---|---|---|---|
| Comparative Example | 21 | 0.0069 | 2.81 | 0.84 | — | 0.03 | 0.0022 | 0.0025 | — | 0.00 |
| | 22 | 0.0058 | 2.76 | 0.80 | 3.51 | 0.04 | 0.0025 | 0.0021 | 0.004 | 0.06 |
| | 23 | 0.0063 | 2.82 | 0.85 | 3.47 | 0.03 | 0.0024 | 0.0019 | 0.036 | 0.55 |
| | 24 | 0.0057 | 2.75 | 0.86 | 3.61 | 0.04 | 0.0029 | 0.0022 | 0.028 | 0.44 |
| Example | 25 | 0.0066 | 2.69 | 0.88 | 3.52 | 0.04 | 0.0028 | 0.0023 | 0.033 | 0.46 |
| | 26 | 0.0072 | 2.77 | 0.85 | 3.60 | 0.03 | 0.0026 | 0.0021 | 0.038 | 0.51 |

TABLE 7

| Sample No. | | Rolling reduction (%) | Continuous finish annealing Temperature (° C.) | Continuous finish annealing Time (sec) |
|---|---|---|---|---|
| Comparative Example | 21 | 82 | 780 | 30 |
| | 22 | 82 | 780 | 30 |
| | 23 | 82 | 780 | 30 |
| | 24 | 90 | 780 | 30 |
| Example | 25 | 90 | 720 | 30 |
| | 26 | 91 | 700 | 30 |

The average grain diameter and the <111> axial density of the non-oriented electrical steel sheets were measured. Epstein specimens and tensile test pieces were cut from the non-oriented electrical steel sheets. The magnetic characteristics were measured using the Epstein specimens, and the mechanical characteristics were measured using the tensile test pieces. Results are shown in Table 8.

TABLE 8

| Sample No. | | Average grain diameter (μm) | <111> Axial density | Magnetic characteristics $W_{15/50}$ (W/kg) | Magnetic characteristics B50 (T) | Magnetic characteristics $W_{10/1000}$ (W/kg) | Mechanical characteristics YP (MPa) | Mechanical characteristics TS (MPa) | Mechanical characteristics EL (%) |
|---|---|---|---|---|---|---|---|---|---|
| Comparative Example | 21 | 22 | 4.8 | 5.5 | 1.65 | 60 | 524 | 622 | 26 |
| | 22 | 23 | 4.9 | 5.4 | 1.66 | 58 | 701 | 795 | 27 |
| | 23 | 19 | 5.1 | 5.7 | 1.66 | 59 | 826 | 871 | 26 |
| | 24 | 20 | 9.7 | 5.9 | 1.65 | 61 | 851 | 902 | 25 |
| Example | 25 | 11 | 10.3 | 6.0 | 1.65 | 53 | 933 | 976 | 26 |
| | 26 | 9 | 12.1 | 6.3 | 1.65 | 49 | 948 | 989 | 28 |

As is known from Table 8, Comparative Example No. 22 was found to show higher levels of yield strength and tensile strength, as compared with Comparative Example No. 21, by virtue of solid solution strengthening contributed by Ni. Comparative Examples No. 23 and No. 24 were found to show higher levels of yield strength and tensile strength, as compared with Comparative Example No. 22, by virtue of precipitation strengthening contributed by Nb carbonitride precipitated in the form of fine grains. While also the non-oriented electrical steel sheet of Comparative Example No. 22 contained Nb, but only at the value $R_{Nb}$ of smaller than 0.1, so that Nb carbonitride hardly precipitated in the form of fine grains. Comparative Example No. 24 showed higher levels of yield strength and tensile strength as compared with Comparative Example No. 23, since the <111> axial density was 6 or larger.

Each of Examples No. 25 and No. 26 showed distinctively higher levels of yield strength and tensile strength, and a distinctively lower level of high-frequency iron loss $W_{10/1000}$ as compared with Comparative Example No. 24, since the $R_{Nb}$ value was 0.1 or larger, the <111> axial density was 6 or larger, and the average grain diameter was 15 μm or smaller. In this way, desirable magnetic characteristics and mechanical characteristics were obtained in Examples No. 25 and No. 26.

Also from Table 7 and Table 8, it is apparent that larger rolling reduction results in larger <111> axial density, and that lower temperature in continuous finish annealing results in smaller average grain diameter.

INDUSTRIAL APPLICABILITY

The present invention is applicable to electrical steel sheet manufacturing industry and electrical steel sheet utilization industry.

The invention claimed is:

1. A method for manufacturing a non-oriented electrical steel sheet comprising:

hot-rolling a slab to obtain a hot-rolled steel sheet, wherein a finish rolling temperature in the hot-rolling is 850° C. or below;

after the hot-rolling, cold-rolling the hot-rolled steel sheet to obtain a cold-rolled steel sheet; and after the cold-rolling, finish-annealing the cold-rolled steel sheet for 25 seconds or shorter at 750° C. or below, wherein the slab comprises:

Si: 2.8 mass % or more and 4.0 mass % or less;

Al: 0.2 mass % or more and 3.0 mass % or less;

P: 0.02 mass % or more and 0.2 mass % or less; and 0.5 mass % or more in total of at least one element selected from the group consisting of 4.0 mass % or less of Ni and 2.0 mass % or less of Mn, a C content in the slab is 0.05 mass % or less, a N content in the slab is 0.01 mass % or less, a balance of the slab is composed of Fe and inevitable impurity.

2. The method according to claim 1, wherein the hot-rolled steel sheet is not annealed prior to the cold-rolling, and intermediate annealing is not performed during the cold-rolling.

3. The method according to claim 2, wherein the hot-rolled steel sheet is coiled at 650° C. or below after the hot-rolling.

4. The method according to claim 1, wherein the hot-rolled steel sheet is coiled at 650° C. or below after the hot-rolling.

5. A method for manufacturing a non-oriented electrical steel sheet comprising:

hot-rolling a slab to obtain a hot-rolled steel sheet, wherein a finish rolling temperature in the hot-rolling is 850° C. or below;

after the hot-rolling, cold-rolling the hot-rolled steel sheet to obtain a cold-rolled steel sheet; and after the cold-rolling, finish-annealing the cold-rolled steel sheet for 30 seconds or shorter at 740° C. or below, wherein the slab comprises:

Si: 2.8 mass % or more and 4.0 mass % or less;

Al: 0.2 mass % or more and 3.0 mass % or less;

P: 0.02 mass % or more and 0.2 mass % or less; and 0.5 mass % or more in total of at least one element selected from the group consisting of 4.0 mass % or less of Ni and 2.0 mass % or less of Mn, a C content in the slab is 0.05 mass % or less, a N content in the slab is 0.01 mass % or less, a balance of the slab is composed of Fe and inevitable impurity.

6. The method according to claim 5, wherein a time period of the finish-annealing is 25 seconds or shorter.

7. The method according to claim 6, wherein the hot-rolled steel sheet is not annealed prior to the cold-rolling, and intermediate annealing is not performed during the cold-rolling.

8. The method according to claim 7, wherein the hot-rolled steel sheet is coiled at 650° C. or below after the hot-rolling.

9. The method according to claim 6, wherein the hot-rolled steel sheet is coiled at 650° C. or below after the hot-rolling.

10. The method according to claim 5, wherein the hot-rolled steel sheet is not annealed prior to the cold-rolling, and intermediate annealing is not performed during the cold-rolling.

11. The method according to claim 10, wherein the hot-rolled steel sheet is coiled at 650° C. or below after the hot-rolling.

12. The method according to claim 5, wherein the hot-rolled steel sheet is coiled at 650° C. or below after the hot-rolling.

* * * * *